United States Patent [19]

Wrigley

[11] Patent Number: 4,544,199

[45] Date of Patent: Oct. 1, 1985

[54] ADJUSTABLE BOAT SEAT

[75] Inventor: Robert A. Wrigley, Grosse Pointe Farms, Mich.

[73] Assignee: Detroit Marine Engineering, Inc., Detroit, Mich.

[21] Appl. No.: 582,130

[22] Filed: Feb. 24, 1984

[51] Int. Cl.[4] ..... A47C 15/00

[52] U.S. Cl. ..... 297/244; 297/63

[58] Field of Search ..... 297/244, 63, 65

[56] References Cited

U.S. PATENT DOCUMENTS

| | | | |
|---|---|---|---|
| 1,289,442 | 12/1918 | Gordon | 297/65 |
| 1,912,576 | 6/1933 | Gazarian | 297/244 |
| 3,095,234 | 6/1963 | Brooks et al. | 297/244 |
| 3,379,471 | 4/1968 | Dalziel | 297/244 X |
| 3,394,417 | 7/1968 | O'Link | 297/244 |

*Primary Examiner*—Francis K. Zugel

*Attorney, Agent, or Firm*—Barnes, Kisselle, Raisch, Choate, Whittemore & Hulbert

[57] ABSTRACT

A slide-adjustable reclining double seat for boats and like applications comprising a support box and a pair of seats hinged back-to-back resting on the upper edges of the box sidewalls. A locking bar is cantilevered rearwardly beneath each seat bottom. A pair of opposed slides of molded plastic construction are affixed to the box sidewalls and have channels which slidably receive ends of the locking bars. Laterally aligned recesses in the channels define locking positions of the reclining seats.

10 Claims, 12 Drawing Figures

ADJUSTABLE BOAT SEAT

The present invention is directed to adjustable reclining double seats for boats and like applications, and more particularly to an improved track arrangement for use therein.

An object of the present invention is to provide a reclining double seat having an improved adjustment track arrangement which renders the seat more economical to fabricate and assemble, easier to adjust, and structurally stronger and more reliable over an extended operating life than are prior art seats of similar type.

The invention, together with additional objects, features and advantages thereof, will be best understood from the following description, the appended claims and the accompanyin drawings in which:

Figure 5:
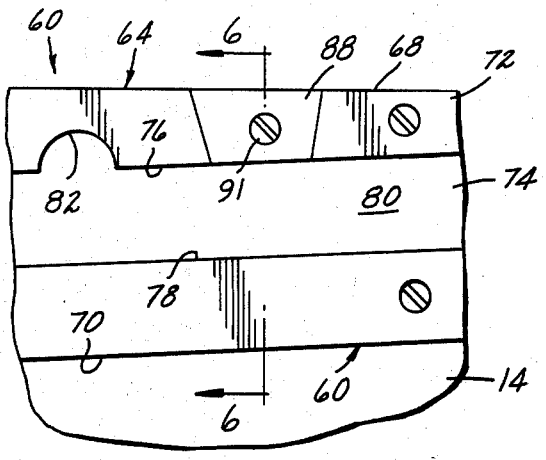
FIG. 5 is a fragmentary view on an enlarged scale showing a portion of FIG. 4 viewed in the direction 5—5 therein.

Referring to the drawings, a boat seat 10 according to the invention is illustrated therein as comprising a hollow rectangular support box 12 having laterally spaced sidewalls 14,16, longitudinally spaced end walls 18,20, and open top and bottom. In the embodiment illustrated, the upper edges 22,24 of box sidewalls 14,16 are inclined slightly downwardly from their opposite ends to the central portions of the two sidewalls. These edges define a pair of complementary inwardly and downwardly inclined flat seat support surfaces along each side of support box 10. The upper edges 26,28 of box end walls 18,20 are coplanar and are positioned slightly below the adjacent ends of the edges 22,24 of the sidewalls as shown in FIG. 5. Suitable slats 30 or the like are affixed to the lower edges of walls 14–20 for mounting seat support box 12 on a boat deck.

A pair of seats 32 arranged back to back are adjustably mounted on seat support box 12. Each seat 32 includes a bottom cushion 36 having a flat base panel 38 of sheet plywood or the like with a pad 40 of foamed rubber mounted thereon and overlaid with a vinyl cover 42. A back cushion 44 includes a flat base panel 46 of sheet plywood having a foamed rubber pad 48 mounted thereon and overlaid with a vinyl cover 50. The base panels 38,46 of each seat are joined to each other by a piano hinge 52 and have widths greater than the dimension between box sidewalls 14,16, so that both panels 46,38 may rest flat upon and be supported by the inclined upper edges 22,24 of the box sidewalls. The base panels 46 of the two seats are joined at their upper edges by a piano hinge 54.

Figure 1:
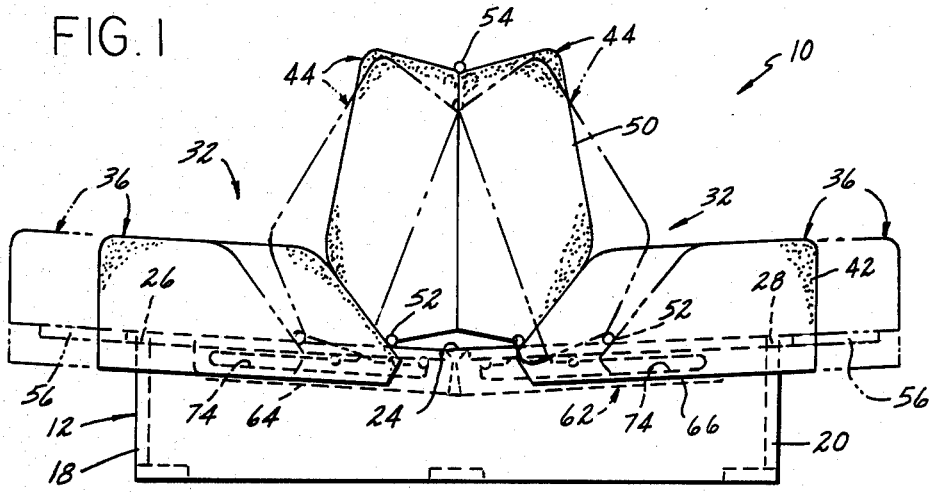
FIG. 1 is a side elevational view of a presently preferred embodiment of a reclining double seat in accordance with the invention.
Figure 2:
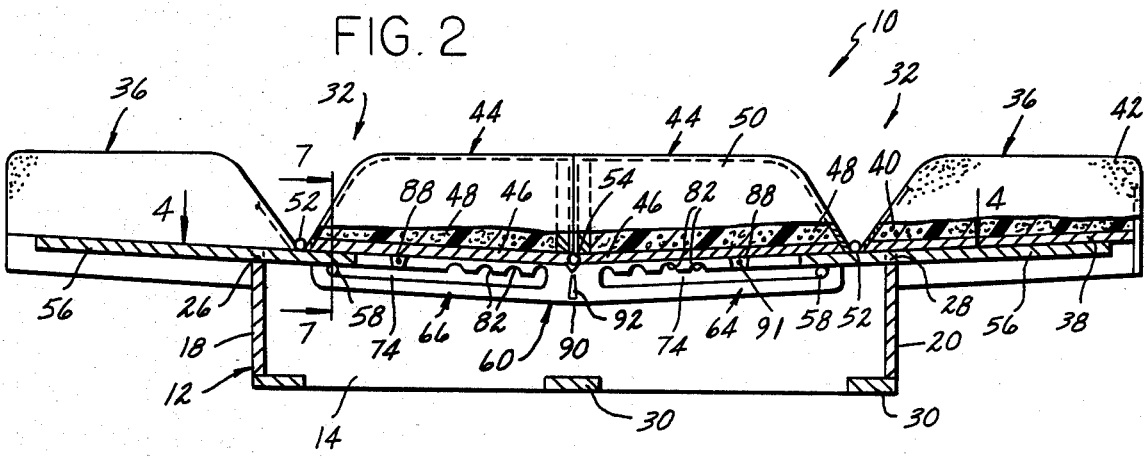
FIG. 2 is a partially sectioned view similar to that of FIG. 1 showing the seat in the fully extended reclining position.
Figure 3:
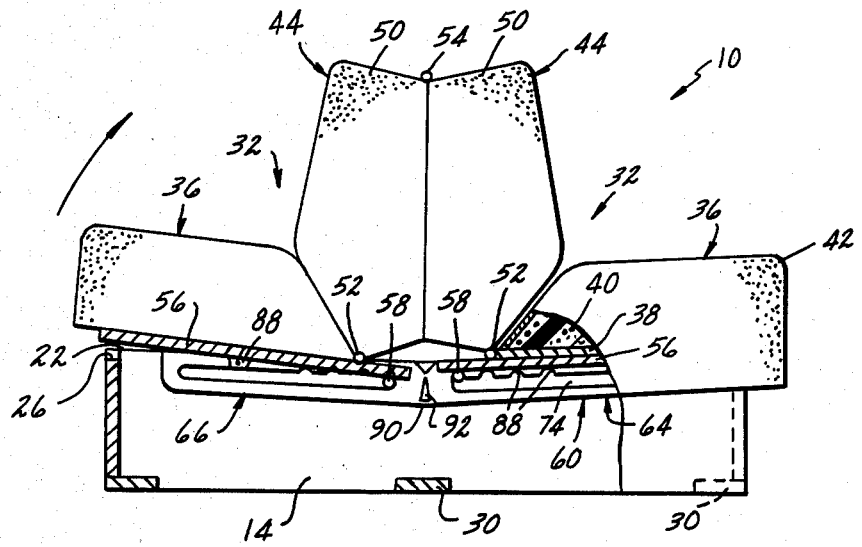
FIG. 3 is a partially sectioned side elevational view of the seat of FIG. 1.
Figure 4:
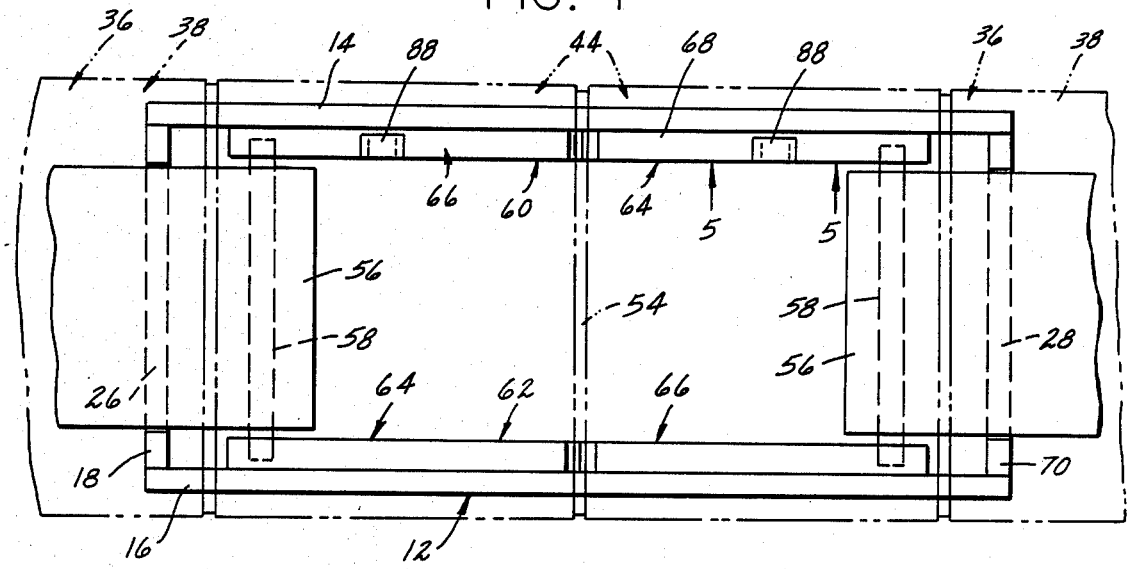
FIG. 4 is a sectional view taken along the line 4—4 in FIG. 2.
Figure 7:
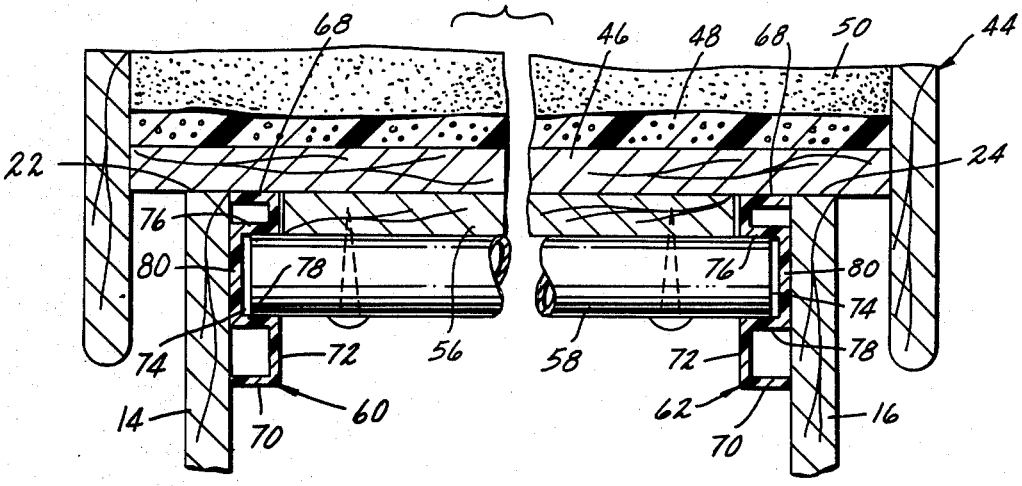
FIG. 7 is a sectional view taken along the line 7—7 in FIG. 2.

A slide panel 56 of sheet plywood or the like is affixed to the base 36 of each bottom seat cushion 36 and projects rearward therefrom toward the longitudinal center of seat support box 12. The width of each panel 56 is less than the dimension between box sidewalls 14,16, so that panels 56 lie below the seat support surfaces 22,24 when the seat bottom cushions rest thereon, as best shown in FIG. 7. A locking bar 58 of tubular steel is affixed to the underside of each panel 56 adjacent to the rearward edge thereof and extends laterally within box 12 between sidewalls 14,16. As shown in FIGS. 1–3, the upper end wall edges 26,28 are spaced below the adjacent ends of the seat support surfaces 22,24 by at least the thickness of panels 56. To the extent thus far described, seat 10 is basically the same as prior art seats of similar type.

Figure 6:
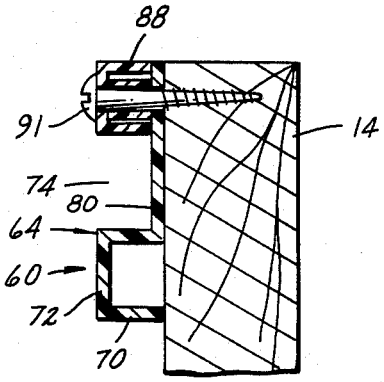
FIG. 6 is a sectional view taken along the line 6—6 in FIG. 5.
Figure 8:
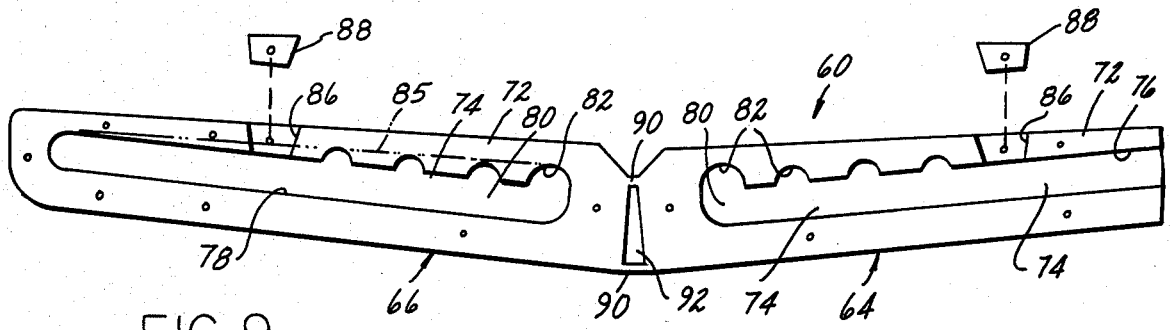
FIGS. 8–9 are front and rear elevational views of one seat track in accordance with the invention.
Figure 9:
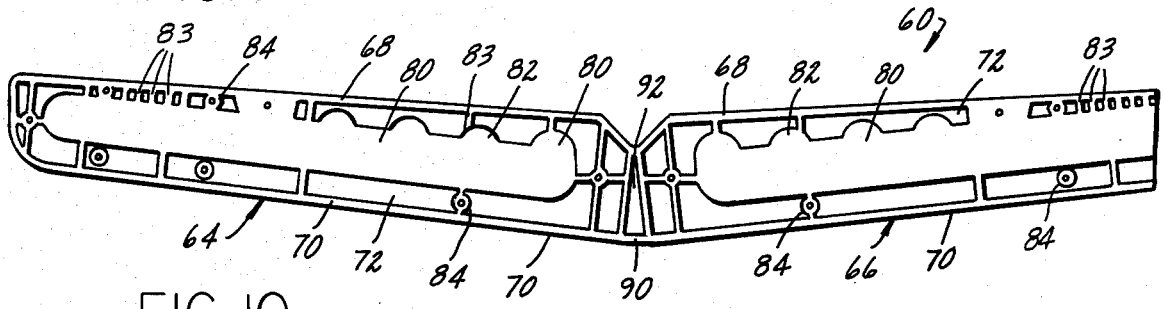

In accordance with the present invention, a pair of laterally opposed tracks 60,62 are respectively affixed to the inner faces of sidewalls 14,16 adjacent to the upper sidewall edges 22,24. Tracks 60,62 are each of one-piece molded plastic construction. Track 60 includes opposite longitudinally extending track sections 64,66 which are mirror images of each other about the lateral center plane of seat box 12. Each track section 64,66 is of generally C-shaped cross section (FIGS. 6–7), having upper and lower walls 68,70 integrally connected by a sidewall 72 which is parallel to and spaced in assembly from the associated box sidewall 14. A channel 74 is formed in each sidewall 72 and extends longitudinally of the associated track section 64,66. Channel 74 is defined by upper and lower channel walls 76,78 contiguous with base wall 72, and a channel bottom wall 80 integrally bridging walls 76,78. Lower channel wall 78, bottom wall 80 and the forward or outer end portion of top wall 76 are smooth and straight. The rear or inner end portion of upper channel wall 76 has a plurality of upwardly extending spaced semi-circular recesses 82. Internally of each slide section 64,66, that is, on the side thereof facing the associated sidewall of the box, and as best seen in FIG. 9, a plurality of integrally molded strengthening ribs 83 extend between walls 76,68 and 78,70 from sidewall 72 to channel bottom wall 80 (FIG. 7). A number of these ribs 83 are enlarged to form bosses 84 through which openings extend for mounting slides 60,62 to the box sidewalls. It will be observed that ribs 83 are greater in number and are more closely spaced along the forward or outer end portion of each track section than at the portion thereof in which recesses 82 are formed. An upwardly opening V-shaped slot 86 (FIG. 8) is formed by integral walls extending between walls 68,76 in track sections 64,66. A separate filler block 88 is adapted to be received and affixed within slot 86. Track 62 is identical to track 60 with the exception of slots 86 and blocks 88, which are omitted from track 62.

Figure 10:
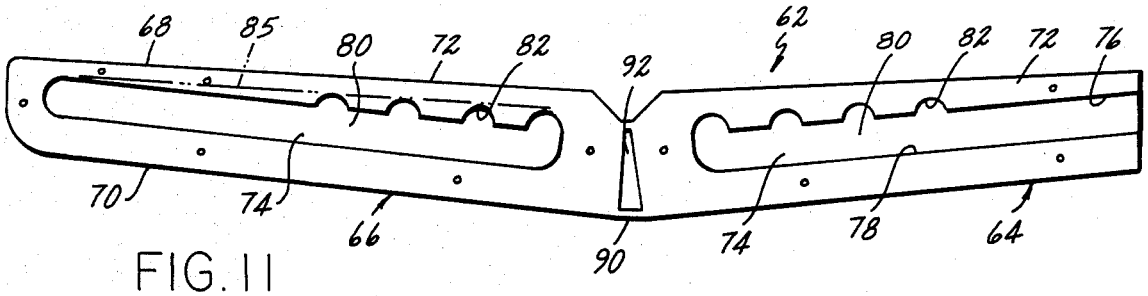
FIGS. 10–11 are front and rear elevational views of the opposing seat track in accordance with the invention.
Figure 11:
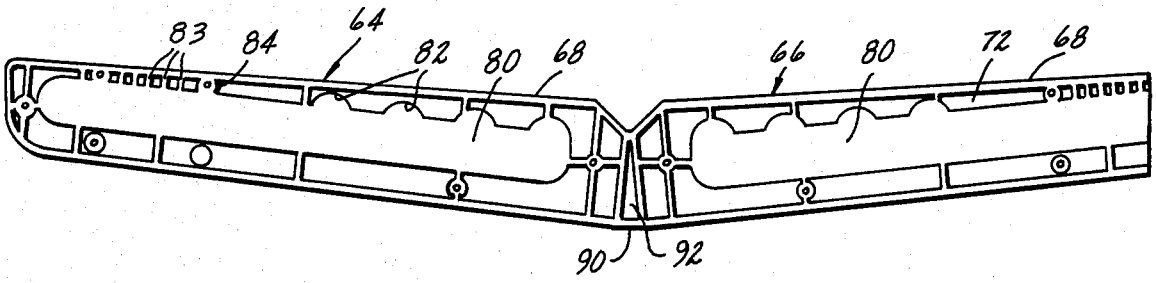

In assembly, tracks 60,62 are mounted in opposed alignment to the box sidewalls. It will be noted that slots 74 in track sections 64,66 are not parallel to sidewall upper track edges at walls 68, and that the vertical extent of the successive recesses 82 decreases in a direction forwardly or outwardly of the track section edges. However, the upper ends of recesses 82 are aligned straight with each other and with the forward end of the channel upper wall 76 on a line 85 (FIGS. 8 and 10) parallel to top wall 68 and also to the upper box edges 22,24 and spaced therefrom by the thickness of panel 56. With filler blocks 88 removed from track 60, seats 32 are positioned over box 12 and one end of each bar 58 is positioned within the channels 74 of track 62. The opposite end of each bar is then directed downwardly through slot 86 into channels 74 of track 60, and blocks 88 are mounted within slots 86 by the screws 91 so as to capture bars 58 in position, and thus to affix seats 32 to box 12.

To adjust the position of each seat 32, the forward edge of the associated seat bottom is lifted off of box 12 and pivoted upwardly as shown in FIG. 3. Since seat base 38 is wider than box 12 (FIG. 7), and panel 56 is narrower than box 12, the rear edge of panel 56 is pivoted downwardly by such upward lifting of the seat forward edge, so that bar 58 is pivoted downwardly from within a recess 82. Continued upward lifting of the seat forward edge will bring bar 58 into engagement with the flat channel bottom wall 78. Bottom cushion 36 may now be slid forwardly to desired position, such as the semi-reclining position illustrated in phantom in FIG. 1 or the fully-reclining position illustrated in FIG. 2. The front end of bottom cushion is then lowered so that base 38 engages box 12. In the semi-reclining position (FIG. 1), bar 58 is engaged with one of the forward locking recesses 82. To position the seats in the fully reclining position, both seat cushions may be slid to the forwardmost position (FIG. 2) so that each bar 58 is shifted to the forward end of its associated channel 74. In this position, the base panels 38,46 of both seats are flush with and supported on the upper edges 22,24 of the box sidewalls. It will be appreciated that since the two seats are hinged together adjacent their upper ends as at 54, both back cushions are tilted to a partially reclining position when either of the bottom cushions are shifted forwardly.

Figure 12:
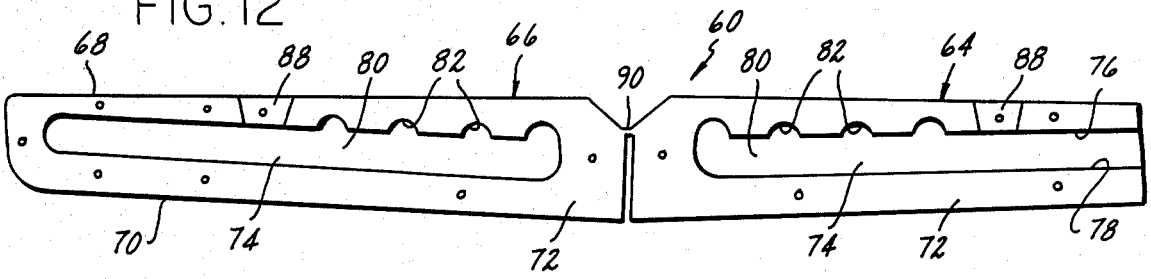
FIG. 12 is an elevational view showing a modification to the track of FIG. 8.

As previously noted, the upper edges 22,24 of box sidewalls 14,16 form an inclined V-shaped contour. Preferably, all slides 60,62 are constructed so that the upper walls 68 of each slide section are likewise inclined at this contour. The bottom cushion 36 of each seat 32 is constructed such that its top supporting surface is similarly inclined as shown in FIG. 1 when the tracks are mounted on the box sidewalls as shown in the drawings. Slide sections 64,66 are interconnected by the spaced integral webs 90, leaving an inverted V-shaped opening 92 bounded by webs 90 and the opposing inner ends of slide sections 64,66. The sum of the included angle of opening 92 and the included angle of upper walls 68 equal one hundred eighty degrees. Thus, if it is desired to have the support surfaces of the bottom cushions horizontal where the upper edges 22,24 of the box sidewalls are straight rather than V-shaped, the lower web 90 of each track can be cut away as shown in FIG. 12 and the tracks can be mounted on the box with the inner ends of the two track sections pivoted together in abutting relation.

The slide arrangement so described provides significant improvement in terms of strength, and economy of fabrication and assembly over prior art arrangements which comprise a strip of wood fastened to the inner face of each box sidewall and having downwardly facing locking recesses cut along one edge thereof. In such prior art arrangements, the seat bottoms slide along the box itself, while in the present invention, the seat bottoms ride on the bars 58 during adjustment, with the bar being slidably retained in associated plastic tracks. With filler blocks 88 in place, the track channels of the present invention are closed and capture the ends of bars 58. Thus, seats 32,34 may not be inadvertently separated from box 12 during position adjustment. Strengthening ribs 83 and bosses 84, coupled with the C-shaped cross section of the track sections, impart rigidity and strength to withstand rugged use and abuse over an extended useful life. The provision of the closely spaced ribs 83 adjacent forward ends of the track sections is especially desirable since in the fully reclined position of the seats the bars 58 engage the forward ends of the track channels to support the bottom cushions of the seat in an over hanging cantilever manner relative to the opposite ends of the seat support box.

The invention claimed is:

1. An adjustable reclining double seat for boats and like application comprising a support including spaced sidewalls having upper edges, a pair of seats each including a bottom and a back hinged together, the backs of both seats being hinged together adjacent their upper ends, said backs and said bottoms including base means adapted to rest upon said upper edges, a pair of locking bars secured one to each of the base means of said bottoms and extending between said spaced sidewalls, and a pair of molded plastic tracks mounted in opposed relation on the inner faces of said sidewalls, each of said tracks including a closed channel which extends lengthwise of the seat and slidably retains the opposite ends of said locking bars, each channel having at least one vertically extending recess for receiving one end of said bar when said seat bottom base means are resting on said upper edges.

2. The seat set forth in claim 1 wherein said tracks are substantially identical and each comprises a single integral molding which is C-shaped in vertical cross section.

3. The seat set forth in claim 2 wherein said C-shaped cross section comprises upper and lower walls and a base wall adjacent the associated sidewall of the support, said top and bottom walls being connected together at their opposite ends so as to peripherally enclose and define said channel.

4. The seat set forth in claim 3 wherein each of said top and bottom walls comprise a pair of vertically spaced webs and including integrally molded strengthening ribs extending vertically between said webs above and below each channel.

5. The seat set forth in claim 4 wherein each of said tracks comprises a pair of oppositely extending track sections which are mirror images of each other and which are integrally connected at their adjacent ends.

6. The seat set forth in claim 5 wherein each said track section includes a separate channel.

7. The seat set forth in claim 6 comprising a plurality of said recesses in each of said channels, each recess in one track being laterally aligned with a corresponding said recess in the opposing track.

8. The seat set forth in claim 7 wherein each channel is at an acute angle with respect to the said upper edge of the associated said sidewall, and wherein the upper ends of said recesses lie in a line generally parallel to the upper edge of the associated sidewall.

9. The seat set forth in claim 7 wherein one of said tracks includes a removable member adapted to define an edge portion of each channel, said member when removed permitting insertion and removal of an associated bar end into and from said channel.

10. The seat set forth in claim 9 wherein the two sections of each track are interconnected adjacent the upper and lower edges thereof at their adjacent ends, at least one of said connections being adapted to be severed so that the two sections can be pivoted relative to each other about the unsevered connection and thereby vary the horizontal inclination of one track relative to the other.

* * * * *